US012409356B2

(12) United States Patent
Mish et al.

(10) Patent No.: US 12,409,356 B2
(45) Date of Patent: Sep. 9, 2025

(54) FREESTYLE REMOVABLE DIVING BOARD

(71) Applicants: Kathryn E Mish, Penngrove, CA (US); William Cory Mish, Penngrove, CA (US)

(72) Inventors: Kathryn E Mish, Penngrove, CA (US); William Cory Mish, Penngrove, CA (US)

( * ) Notice: Subject to any disclaimer, the term of this patent is extended or adjusted under 35 U.S.C. 154(b) by 206 days.

(21) Appl. No.: 18/375,491

(22) Filed: Sep. 30, 2023

(65) Prior Publication Data

US 2024/0108931 A1 Apr. 4, 2024

Related U.S. Application Data

(60) Provisional application No. 63/412,473, filed on Oct. 2, 2022.

(51) Int. Cl.
*A63B 5/08* (2006.01)

(52) U.S. Cl.
CPC ..... *A63B 5/08* (2013.01); *A63B 2005/085* (2013.01)

(58) Field of Classification Search
CPC . A63B 5/08; A63B 2005/085; A63B 2210/50; A63B 5/10
See application file for complete search history.

(56) References Cited

U.S. PATENT DOCUMENTS 2,630,333 A * 3/1953 Petersen ..... B62M 1/28 74/96
2,847,218 A * 8/1958 Gerritsen ..... A63B 5/10 482/30
2,852,258 A * 9/1958 Dunklee ..... A63B 5/10 482/31
2,996,295 A * 8/1961 Smith ..... A63B 5/10 24/570
3,030,108 A * 4/1962 Baker ..... A63B 5/10 403/33
3,092,383 A * 6/1963 Dunn ..... A63B 5/10 182/115
3,096,980 A * 7/1963 Gauer ..... A63B 5/10 482/33
3,300,209 A * 1/1967 Friis ..... A63B 5/10 482/31
3,321,204 A * 5/1967 Pretti ..... A63B 5/10 482/32
3,390,740 A * 7/1968 Brandel ..... A63B 5/10 182/115
3,516,660 A * 6/1970 Bellinson ..... A63B 5/10 D25/41.1
3,767,193 A * 10/1973 Johnson ..... A63B 5/10 182/223
3,856,296 A * 12/1974 Fischer ..... A63B 5/10 482/31

(Continued)

*Primary Examiner* — Garrett K Atkinson
(74) *Attorney, Agent, or Firm* — Eric Hanscom

(57) ABSTRACT

A portable diving board is attachable to a receiver, such as boats, docks and other aquatic structures, through removable clamps. The board portion is attached to a platform box and given resiliency through a spring. Each clamp has a bi-through threaded nut attached to its lower portion, such that vertical and horizontal pressure rods can be rotated by knob to tight and release the clamps from the receiver. Pressure distribution pads at the end of each pressure rod allow for even distribution of pressure, thereby protecting the receiver from damage.

17 Claims, 4 Drawing Sheets

(56) References Cited

U.S. PATENT DOCUMENTS

| | | | | |
|---|---|---|---|---|
| 5,916,031 | A * | 6/1999 | Casillan | A63B 5/10 4/503 |
| 2009/0113608 | A1* | 5/2009 | Chou | A63B 33/002 2/452 |
| 2009/0229967 | A1* | 9/2009 | Sakatani | B01J 35/39 204/157.3 |
| 2015/0280337 | A1* | 10/2015 | Chawla | H01R 11/24 439/59 |
| 2023/0376130 | A1* | 11/2023 | Liu | G06F 3/03547 |
| 2024/0010478 | A1* | 1/2024 | Walsh | A63B 5/10 |
| 2024/0400183 | A1* | 12/2024 | Zhao | B63H 11/08 |

* cited by examiner

FREESTYLE REMOVABLE DIVING BOARD

CROSS REFERENCE TO RELATED APPLICATIONS

This utility patent application claims priority from U.S. Provisional No. 63/412,473, filed 2022 Oct. 2, the contents of which are incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of aquatic entertainment devices, and more specifically to a removable and portable diving board that can be used on a variety of watercraft, pontoons, docks, and other items located in water environments.

Brief Description of Invention

The present invention is a diving board that can removably attach to a variety of aquatic structures, such as boats, floating rafts and pretty much any other structure with at least one solid side The invention is attachable to boats, docks and other aquatic structure through removable clamps. The board portion is attached to a platform box and given resiliency through a spring. The clamps are also attached to the platform box and have adjustment knobs that can be easily tightened and loosened to quickly and easily attach or remove the diving board. It requires no holes, cement or other permanent modifications to the structure upon which it is attached.

Statement of the Problem. Diving or jumping into the water is an entertaining form of aquatic exercise. To do this safely, however, it is important to distance yourself from the boat or dock from which you are jumping or diving to avoid hitting yourself on the way to the water. It is also entertaining to jump or dive off a diving board, as the springiness allows you to jump or dive higher and further away that you could do using only your leg power. Jumping or diving off the end of a diving board is a good way to distance yourself from the edge of the boat or dock, and therefore is a safer way to enter the water.

The problem that arises is how to use a diving board in these situations. There are diving boards that can be attached to boats and docks by drilling holes and permanently attaching the diving board, including products by Lllipad, H20 Marine, S. R. Smith and Duraflex International, but these products present several problems. First, you may not always want the diving board attached. For example, if you permanently install a diving board on your boat, uninvited children may swim to your boat, use the diving board, and subject you to liability through the doctrine of "attractive nuisance". Second, the idea of drilling holes in a boat is not something that many boat owners are going to be comfortable doing, as holes can expand and crack, and should the owner decide to remove the diving board, there will be several holes in the side of the boat that will need to be filled. Third, the prices of the current products on the market range from $1,000 to nearly $6,000, making them prohibitively expensive for many water enthusiasts. Fourth, the products on the market are bulky and difficult to store.

The prior art does show some marginally transportable diving boards. For example, U.S. Pat. No. 2,764,413 to Kenneth Wisner who patented a sturdy and durable diving board structure, which is quickly and easily adjustable in its preferred form for different weights of persons who may use the diving board. While this invention uses some of the basic technology of the current invention, it is not easily transported from one location to another, and even if it were to be easily transported, is not nearly as compact as the current invention. Likewise, U.S. Pat. No. 2,812,180 to Leopold Cymbal illustrates a strong, well-built and adjustable diving board which, like Wisner, is neither compact nor easily transported. U.S. Pat. No. 721,463 to Dahlberg and Jeffers represents yet another diving board that was designed much more for function rather than transportability.

Solution presented. The current invention provides just such a solution by having a diving board that can be easily attached and then removed when not in use. The diving board is easily attachable to a variety of aquatic platforms, so truly serves as a "one size fits all" portable diving board. It can be made in a variety of sizes, and with different sizes of springs to provide varying amount of spring in the diving board. It is simple in construction and therefore low cost and easy to repair, as the unit in modular in design such that an owner can replace a single broken part without having to replace the entire unit.

Statement of the Invention

The invention is a portable diving board that is attachable to boats, docks and other aquatic structures through removable clamps. The board portion is attached to a platform box and given resiliency through a spring.

OBJECTS OF THE INVENTION

It is a primary object of the invention to provide a portable diving board that is easily carried, easy to install, easy to break down and store, and won't pinch fingers during attachment and detachment.

It is a second object of the invention to provide a diving board that can be easily attached and removed from a variety of aquatic items, such as but not limited to boats, docks, floating pontoons.

It is a third object of the invention to provide a portable diving board that has resiliency caused by a spring.

It is a fourth object of the invention to provide a portable diving board with a platform box that both stabilizes the diving board and provides a point of attachment for springs, wherein the springs removably attach the device to a boat, dock, or other structure.

There has thus been outlined, rather broadly, the more important features of the invention in order that the detailed description thereof may be better understood, and in order that the present contribution to the art may be better appreciated. There are additional features of the invention that will be described hereinafter, and which will form the subject matter of the claims appended hereto. The features listed herein, and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

The present invention is an easily removable diving board that can be attached to a wide variety of different structures.

Figure 1:
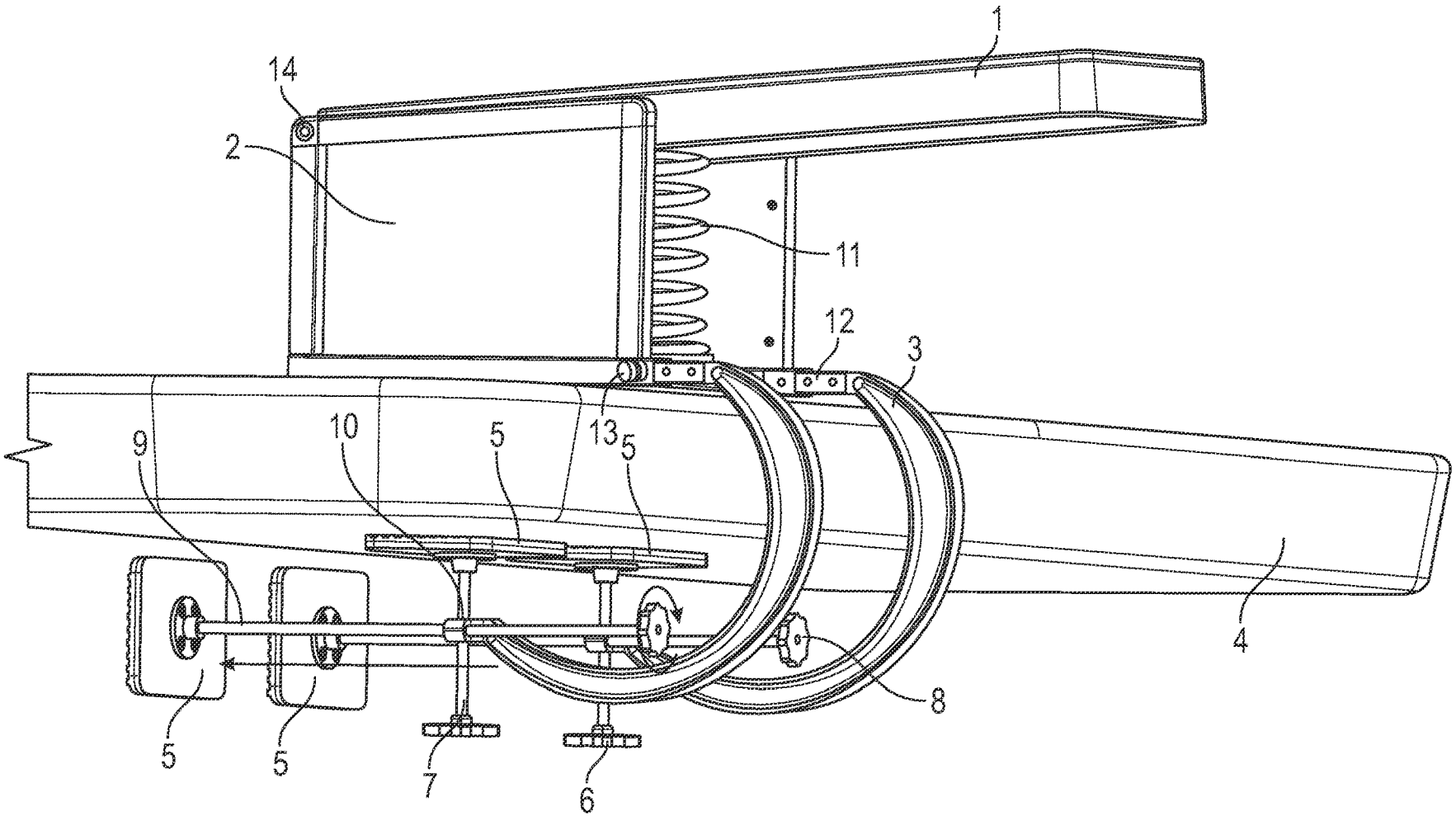
FIG. 1 is a perspective view of the invention as mounted to a flat dock side.

FIG. 1 is a perspective view of the invention as mounted to a flat dock side 4. As a general overview of the invention, a platform box 2 is removably attached to a receiver 4 (in this case a flat, horizontal piece of wood from a dock) by clamps 3. A diving board 1 is attached to the top of the platform box 2 by a hinge 14 and a spring 11. The clamps 3 are removably attached via adjustable C-clamp extensions 12 to the platform box 2 in clamp receiver slots 15 in the bottom of the platform box, which can be adjusted by securing pins 13, which are spring-loaded and can be pulled out to adjust the depth of the clamps, then reinserted into holes in the C-clamp extensions 12. The clamps 3 removably attach the platform box to the receiver 4 with vertical pressure rods 7, which can be tightened and loosened with vertical knobs 6. To minimize damage to the receiver 4, at the end of each vertical pressure rod 7 is a pressure distribution pad 5, which spreads the force of the bolt over a larger area. The clamps 3 are secured in a horizontal direction by horizontal pressure rods 9, which are adjusted by horizontal knobs 8. To minimize damage to the lower part of receiver 4, at the end of each horizontal pressure rod 9 is a pressure distribution pad 5, which spreads the force of the bolt over a larger area. The horizontal pressure rods 9 and vertical pressure rods 7 are adjusted through bi-through threaded nuts 10, which are found at the lower end of each C-clamp 3. A spring 8 provides resiliency to the diving board and makes jumping or diving off the diving board more entertaining.

Figure 2:
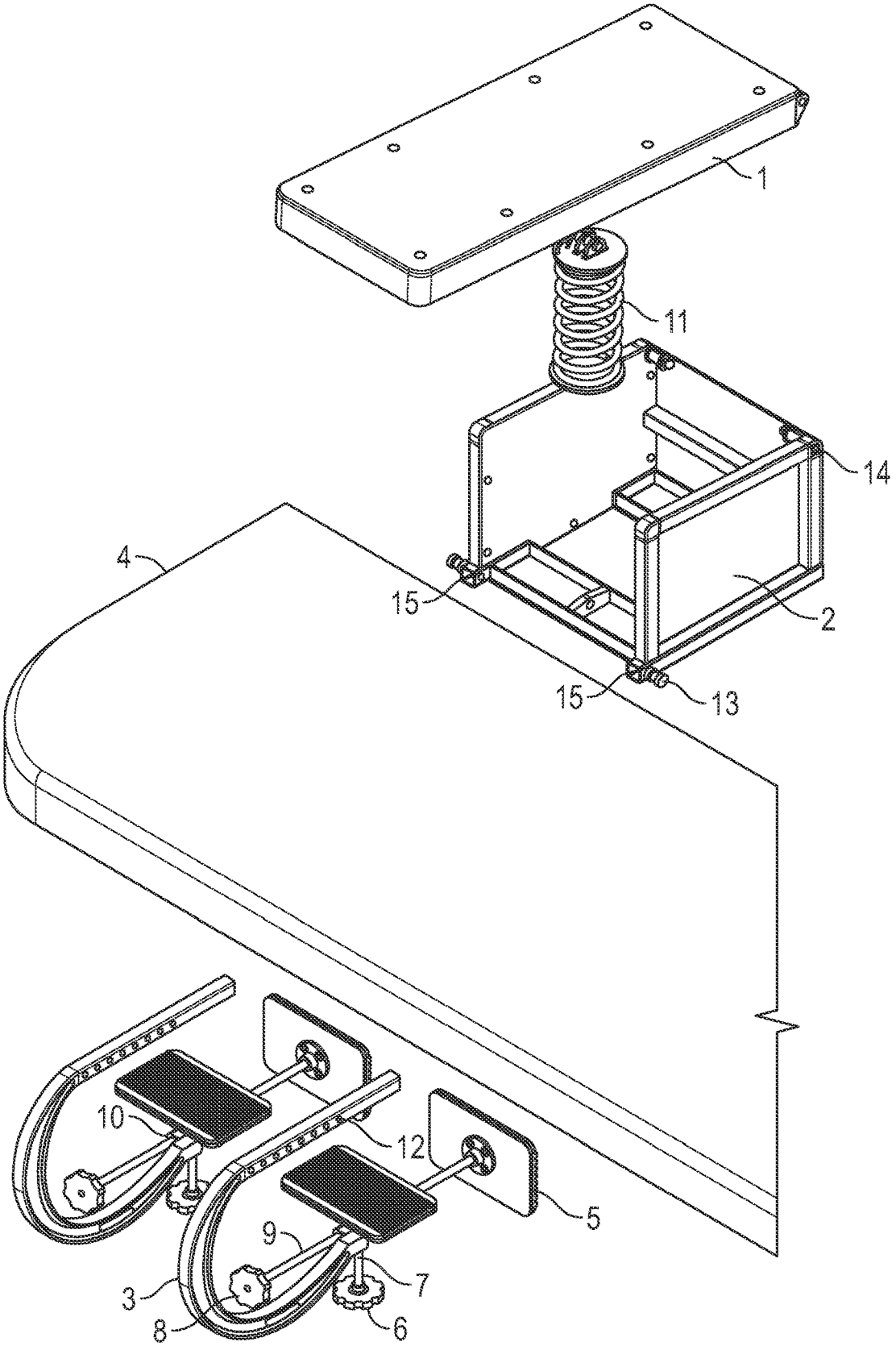
FIG. 2 is an exploded view of the various components of the invention.

FIG. 2 is an exploded view of the various components of the invention. To attach the invention, a user merely removes the clamps 3 from their storage location in the platform box 2, inserts one end into the clamp receiver slot 15 and secures the clamp into the clamp receiver slot with a securing pin 13. A spring 11, provides bounce to the diving board 1. A hinge 14, secures one end of the diving board 1 to the platform box 2. To secure the invention to the receiver 4 in a vertical sense, the user then tightens the clamp 3 by turning the vertical knob 6, which rotates the vertical pressure rod 9 through the bi-through threaded nut 10 portion of the C-clamp 3, forcing the pressure distribution pad 5 against the bottom of the receiver 4, when forces the bottom of the platform box 2 against the receiver 4. To secure the invention to the receiver 4 in a horizontal manner, the user turns the horizontal knob 8, which rotates the horizontal pressure rod 9 through the bi-directional threaded nut 10, which is found at the lower end of each C-clamp 3, which forces another pressure distribution pad 5 against a horizontal side of the receiver 4. When a user wants to remove the invention, he/she merely releases pressure by unscrewing the vertical knob 6 and horizontal knob 8, then pulling the securing pins 13 and removing the clamps 3 from the platform box 2.

Figure 3:
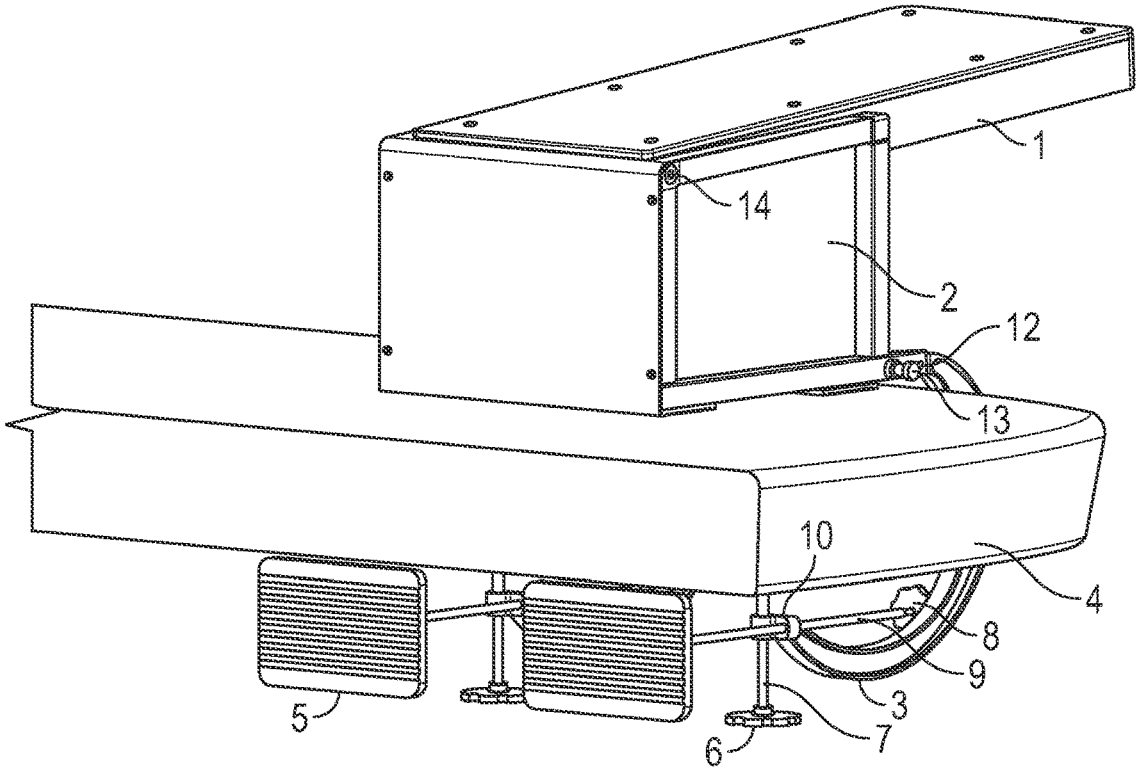
FIG. 3 is a back, perspective view of the invention as mounted.

FIG. 3 is a back, perspective view of the invention as mounted. In this figure, the platform box 2 is removably attached to the receiver 4 by clamps 3. A diving board 1 is attached to the top of the platform box 2 by a hinge 14 and a spring (not visible in this figure). The clamps 3 are removably attached via adjustable C-clamp extensions 12 to the platform box 2 in clamp receiver slots (not visible from this angle) in the bottom of the platform box, which can be adjusted by securing pins 13, which are spring-loaded and can be pulled out to adjust the depth of the clamps, then reinserted into holes in the C-Clamp extensions 12. The clamps 3 removably attach the platform box to the receiver 4 with vertical pressure rods 7, which can be tightened and loosened with vertical knobs 6. To minimize damage to the receiver 4, at the end of each vertical pressure rod 7 is a pressure distribution pad 5, which spreads the force of the bolt over a larger area. The clamps 3 are secured in a horizontal direction by horizontal pressure rods 9, which are adjusted by horizontal knobs 8. To minimize damage to the lower part of receiver 4, at the end of each horizontal pressure rod 9 is a pressure distribution pad 5, which spreads the force of the bolt over a larger area. The horizontal pressure rods 9 and vertical pressure rods 7 are adjusted through bi-through threaded nuts 10, which are found at the lower end of each C-clamp 3. A spring (not visible in this figure but identified as reference number 11 in other figures) provides resiliency to the diving board and makes jumping or diving off the diving board more entertaining.

Figure 4:
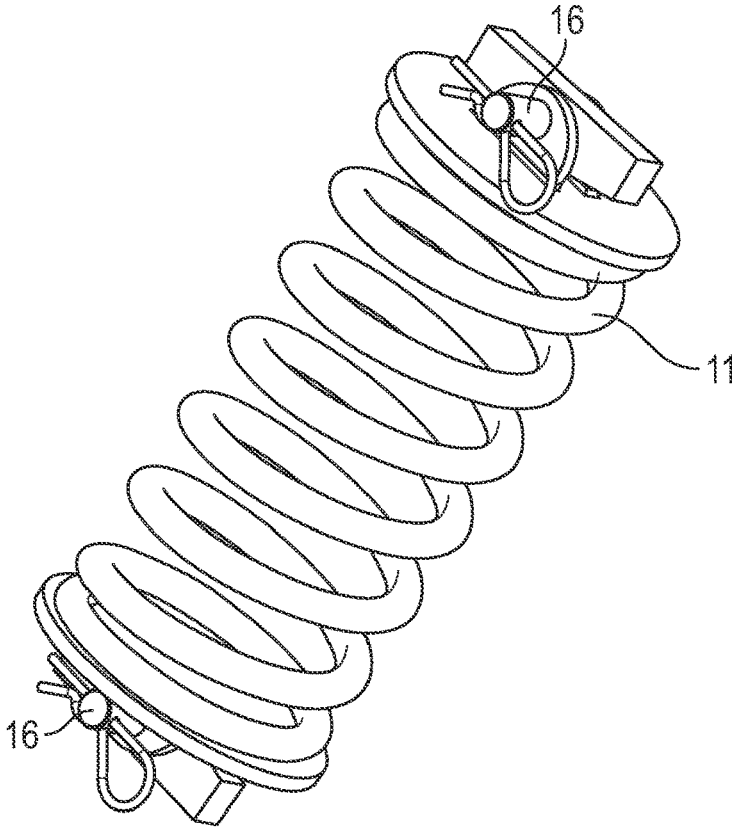
FIG. 4 is a perspective view of the spring portion of the invention.

FIG. 4 is a perspective view of the spring portion of the invention. The spring 11 has cotter pin assemblies at both ends to allow it to be removably secured to the bottom of the diving board (1 in other figures) and the bottom of the platform box (2 in other figures)

Figure 5:
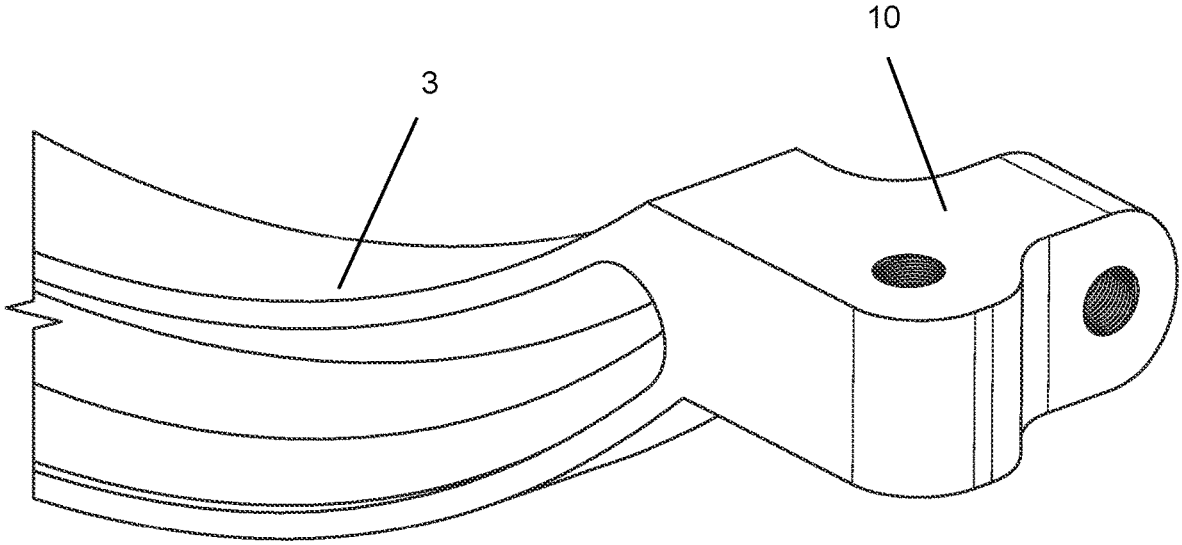
FIG. 5 is a perspective view of the bi-through threaded nut portion of the invention.

FIG. 5 is a perspective view of the bi-through threaded nut 10 portion of the C-clamp. The bi-through threaded nut allows for the device to be secured in both a vertical and horizontal aspect to the receiver (4 in other figures) through the C-clamp, wherein the bi-through threaded nut 10 is located at the bottom end of each C-clamp.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

Reference numbers used:

1. Diving board
2. Platform box
3. C-Clamp
4. Swim platform deck/receiver
5. Pressure distribution pad
6. Vertical Knob
7. Vertical Pressure Rod
8. Horizontal Knob
9. Horizontal Pressure Rod
10. Bi-through threaded nut
11. Spring
12. Adjustable C-Clamp extension
13. Securing pins
14. Hinge
15. Clamp receiver slots

What we claim is:

1. A portable diving board device, comprising a diving board portion, a platform box portion, and a connection portion, wherein the diving board portion comprises a diving board and a hinge, wherein the platform box portion comprises a platform box and a spring, wherein the spring additionally comprises two cotter pin assemblies, with a top cotter pin assembly at a top spring end, wherein the top cotter pin assembly removably connects the top spring end to an underside of the diving board, with a bottom cotter pin assembly connected to a bottom spring end, wherein the bottom cotter pin assembly connects the bottom spring end to a platform box bottom, wherein the hinge rotably attaches the diving board to the platform box, wherein the spring provides a resiliency to the diving board allowing a user to spring off the diving board into a body of surrounding water, wherein the platform box additionally comprises two clamp receiver slots, wherein the connection portion attaches the platform box to a receiver, optionally the edge of a dock, wherein the connection portion comprises two C-clamps, wherein each C-clamp has an adjustable C-clamp extension, wherein the adjustable C-clamp extension fits into one of the clamp receiver slots in the platform box, wherein the adjustable C-clamp extension can be secured in a variety of lengths of extension through securing pins, wherein the connection portion removably secures the platform box to the receiver in both a vertical aspect through two vertical pressure rods, which are rotatable through two vertical knobs, wherein at a vertical end of each of the vertical pressure rods is a pressure distribution pad, and a horizontal aspect through two horizontal pressure rods, which are rotatable through two horizontal knobs, wherein at a horizontal end of each of the horizontal pressure rods is a pressure distribution pad, wherein both the vertical pressure rods and the horizontal pressure rods are threaded through bi-through threaded nuts, wherein each bi-through threaded nut is attached to a lower portion of each of the two C-clamps, such that a user can rotate the vertical knob to secure the platform box to the receiver in a vertical attachment, and can rotate the horizontal knob to secure the platform box to the receiver in a horizontal attachment.

2. The device of claim 1, wherein the diving board has a diving board width, and the platform box has an internal platform box width, and the diving board width is less than the internal platform box width, such that the diving board nestles within the platform box.

3. The device of claim 1, wherein the spring has an upper eye and a lower eye, wherein the top cotter pin assembly removable secures the upper eye to the bottom of the diving board, and the lower cotter pin assembly removably secures the lower eye to the platform box bottom.

4. The device of claim 1, wherein each of the Adjustable C-Clamp extensions additionally comprise a plurality of clamp receiver slot holes, and when an adjustable C-clamp extension is inserted to a clamp receiver slot to a desired depth, a securing pin is snapped into place, thereby securing the C-clamp at a desired location.

5. A portable diving board device, comprising a diving board portion, a platform box portion, and a connection portion, wherein the diving board portion comprises a diving board and a hinge, wherein the platform box portion comprises a platform box and a spring, wherein the hinge rotably attaches the diving board to the platform box, wherein the spring connects the platform box bottom to the diving board, wherein the spring provides a resiliency to the diving board allowing a user to spring off the diving board into a body of surrounding water, wherein the platform box additionally comprises two clamp receiver slots, wherein the connection portion attaches the platform box to a receiver, optionally the edge of a dock wherein the connection portion comprises two C-clamps, wherein each C-clamp has an adjustable C-clamp extension, wherein the adjustable C-clamp extension fits into one of the clamp receiver slots in the platform box, wherein the adjustable C-clamp extension can be secured in a variety of lengths of extension through securing pins, wherein the connection portion removably secures the platform box to the receiver in both a vertical aspect through two vertical pressure rods, which are rotatable through two vertical knobs, wherein at a vertical end of each of the vertical pressure rods is a pressure distribution pad, and a horizontal aspect through two horizontal pressure rods, which are rotatable through two horizontal knobs, wherein at a horizontal end of each of the horizontal pressure rods is a pressure distribution pad.

6. The device of claim 5, wherein the diving board has a diving board width, and the platform box has an internal platform box width, and the diving board width is less than the internal platform box width, such that the diving board nestles within the platform box.

7. The device of claim 5, wherein the spring has an upper eye and a lower eye, wherein the top cotter pin assembly removable secures the upper eye to the bottom of the diving board, and the lower cotter pin assembly removably secures the lower eye to the platform box bottom.

8. The device of claim 7, wherein the spring additionally comprises two cotter pin assemblies, with a top cotter pin assembly at a top spring end, wherein the top cotter pin assembly removably connects the top spring end to an underside of the diving board, with a bottom cotter pin assembly connected to a bottom spring end, wherein the bottom cotter pin assembly connects the bottom spring end to a platform box bottom.

9. The device of claim 5, wherein both the vertical pressure rods and the horizontal pressure rods are threaded through bi-through threaded nuts, wherein each bi-through threaded nut is attached to a lower portion of each of the two C-clamps such that a user can rotate the vertical knob to secure the platform box to the receiver in a vertical attachment, and can rotate the horizontal knob to secure the platform box to the receiver in a horizontal attachment.

10. The device of claim 9, wherein each of the Adjustable C-Clamp extensions additionally comprise a plurality of clamp receiver slot holes, and when an adjustable C-clamp extension is inserted to a clamp receiver slot to a desired depth, a securing pin is snapped into place, thereby securing the C-clamp at a desired location.

11. The device of claim 5, wherein the diving board has a diving board width, and the platform box has an internal platform box width, and the diving board width is less than the internal platform box width, such that the diving board nestles within the platform box, wherein the spring additionally comprises two cotter pin assemblies, with a top cotter pin assembly at a top spring end, wherein the top cotter pin assembly removably connects the top spring end to an underside of the diving board, with a bottom cotter pin assembly connected to a bottom spring end, wherein the bottom cotter pin assembly connects the bottom spring end to a platform box bottom, wherein the spring has an upper eye and a lower eye, wherein the top cotter pin assembly removable secures the upper eye to the bottom of the diving board, and the lower cotter pin assembly removably secures the lower eye to the platform box bottom, wherein both the vertical pressure rods and the horizontal pressure rods are threaded through bi-through threaded nuts, wherein each bi-through threaded nut is attached to a lower portion of each of the two C-clamps, such that a user can rotate the vertical knob to secure the platform box to the receiver in a vertical attachment, and can rotate the horizontal knob to secure the platform box to the receiver in a horizontal attachment, wherein each of the adjustable C-Clamp extensions additionally comprise a plurality of clamp receiver slot holes, and when an adjustable C-clamp extension is inserted to a clamp receiver slot to a desired depth, a securing pin is snapped into place, thereby securing the C-clamp at a desired location.

12. A method of removably attaching a portable diving board device to a receiver, comprising the steps of first, obtaining a portable diving board device, wherein the portable diving board device comprises a diving board portion, a platform box portion, and a connection portion, wherein the connection portion removable attaches the portable diving board device to the receiver, second, using the connection portion to removably connect the portable diving board device to the receiver, wherein the diving board portion comprises a diving board and a hinge, wherein the platform box portion comprises a platform box and a spring, wherein the hinge rotatably attaches the diving board to the platform box, wherein the spring connects the platform box bottom to the diving board, wherein the spring provides a resiliency to the diving board allowing a user to spring off the diving board into a body of surrounding water, wherein the platform box additionally comprises two clamp receiver slots, wherein the connection portion attaches the platform box to a receiver, optionally the edge of a dock, wherein the connection portion comprises two C-clamps, wherein each C-clamp has an adjustable C-clamp extension, wherein the adjustable C-clamp extension fits into one of the clamp receiver slots in the platform box, wherein the adjustable C-clamp extension can be secured in a variety of lengths of extension through securing pins, wherein the connection portion removably secures the platform box to the receiver in both a vertical aspect through two vertical pressure rods, which are rotatable through two vertical knobs, wherein at a vertical end of each of the vertical pressure rods is a pressure distribution pad, and a horizontal aspect through two horizontal pressure rods, which are rotatable through two horizontal knobs, wherein at a horizontal end of each of the horizontal pressure rods is a pressure distribution pad.

13. The method of claim 12, wherein both the vertical pressure rods and the horizontal pressure rods are threaded through bi-through threaded nuts, wherein each bi-through threaded nut is attached to a lower portion of each of the two C-clamps, such that a user can rotate the vertical knob to secure the platform box to the receiver in a vertical attachment, and can rotate the horizontal knob to secure the platform box to the receiver in a horizontal attachment.

14. The method of claim 13, wherein each of the Adjustable C-Clamp extensions additionally comprise a plurality of clamp receiver slot holes, and when an adjustable C-clamp extension is inserted to a clamp receiver slot to a desired depth, a securing pin is snapped into place, thereby securing the C-clamp at a desired location.

15. The method of claim 12, wherein the diving board has a diving board width, and the platform box has an internal platform box width, and the diving board width is less than the internal platform box width, such that the diving board nestles within the platform box.

16. The method of claim 12, wherein the spring has an upper eye and a lower eye, wherein the top cotter pin assembly removable secures the upper eye to the bottom of the diving board, and the lower cotter pin assembly removably secures the lower eye to the platform box bottom, wherein the spring additionally comprises two cotter pin assemblies, with a top cotter pin assembly at a top spring end, wherein the top cotter pin assembly removably connects the top spring end to an underside of the diving board, with a bottom cotter pin assembly connected to a bottom spring end, wherein the bottom cotter pin assembly connects the bottom spring end to a platform box bottom.

17. The method of claim 12, wherein the diving board has a diving board width, and the platform box has an internal platform box width, and the diving board width is less than the internal platform box width, such that the diving board nestles within the platform box, wherein the spring has an upper eye and a lower eye, wherein the top cotter pin assembly removable secures the upper eye to the bottom of the diving board, and the lower cotter pin assembly removably secures the lower eye to the platform box bottom, wherein the spring additionally comprises two cotter pin assemblies, with a top cotter pin assembly at a top spring end, wherein the top cotter pin assembly removably connects the top spring end to an underside of the diving board, with a bottom cotter pin assembly connected to a bottom spring end, wherein the bottom cotter pin assembly connects the bottom spring end to a platform box bottom, wherein the connection portion comprises two C-clamps, wherein each C-clamp has an adjustable C-clamp extension, wherein the adjustable C-clamp extension fits into one of the clamp receiver slots in the platform box, wherein the adjustable C-clamp extension can be secured in a variety of lengths of extension through securing pins, wherein the connection portion removably secures the platform box to the receiver in both a vertical aspect through two vertical pressure rods, which are rotatable through two vertical knobs, wherein at a vertical end of each of the vertical pressure rods is a pressure distribution pad, and a horizontal aspect through two horizontal pressure rods, which are rotatable through two horizontal knobs, wherein at a horizontal end of each of the horizontal pressure rods is a pressure distribution pad, wherein both the vertical pressure rods and the horizontal pressure rods are threaded through bi-through threaded nuts, wherein each bi-through threaded nut is attached to a lower portion of each of the two C-clamps, such that a user can rotate the vertical knob to secure the platform box to the receiver in a vertical attachment, and can rotate the horizontal knob to secure the platform box to the receiver in a horizontal attachment, wherein each of the Adjustable C-Clamp extensions additionally comprise a plurality of clamp receiver slot holes, and when an adjustable C-clamp extension is inserted to a clamp receiver slot to a desired depth, a securing pin is snapped into place, thereby securing the C-clamp at a desired location.

* * * * *